United States Patent [19]

Nagabhushan

[11] Patent Number: 4,750,423

[45] Date of Patent: Jun. 14, 1988

[54] METHOD AND SYSTEM FOR DISPENSING SUB-UNITS TO ACHIEVE A SELECTED TARGET IMPACT PATTERN

[75] Inventor: Bellur L. Nagabhushan, North Canton, Ohio

[73] Assignee: Loral Corporation, New York, N.Y.

[21] Appl. No.: 25,046

[22] Filed: Mar. 12, 1987

Related U.S. Application Data

[63] Continuation-in-part of Ser. No. 824,826, Jan. 31, 1986, Pat. No. 4,676,167.

[51] Int. Cl.[4] ..... F42B 13/50; F42B 25/16

[52] U.S. Cl. ..... 89/1.51; 89/1.11; 102/393; 102/489

[58] Field of Search ..... 89/1.11, 1.51; 102/393, 102/489, 351, 357

[56] References Cited

U.S. PATENT DOCUMENTS

| | | | |
|---|---|---|---|
| 2,362,414 | 11/1944 | Simpson | 102/393 |
| 2,972,946 | 2/1961 | Poulter | 102/393 |
| 3,016,011 | 1/1962 | Brown | 102/393 |
| 3,093,072 | 6/1963 | Pigman | 102/393 |
| 3,608,426 | 9/1971 | Jackson, Jr. | 89/1.51 |
| 3,983,783 | 10/1976 | Maxey | 102/393 |
| 4,143,836 | 3/1979 | Rieger | 102/393 |
| 4,172,407 | 10/1979 | Wentink | 89/1.11 |
| 4,372,216 | 2/1983 | Pinson et al. | 102/393 |
| 4,381,692 | 5/1983 | Weintraub | 102/364 |
| 4,406,227 | 9/1983 | Beeker et al. | 102/351 |
| 4,444,117 | 4/1984 | Mitchell | 102/489 |
| 4,455,943 | 6/1984 | Pinson | 102/489 |
| 4,488,489 | 12/1984 | Schöffl | 102/489 |
| 4,498,393 | 2/1985 | Fischer et al. | 102/489 |
| 4,555,971 | 12/1985 | Romer et al. | 89/1.11 |
| 4,583,461 | 4/1986 | Weber | 102/489 |
| 4,616,567 | 10/1986 | Romer et al. | 89/1.11 |
| 4,651,648 | 3/1987 | Alon | 102/357 |

OTHER PUBLICATIONS

Navy Tech Catalog 0501, Case Nos. 68837 and 68839, A. H. Ryan, vol. II, No. 1, 09/1985.

*Primary Examiner*—David H. Brown

*Attorney, Agent, or Firm*—P. E. Milliken; L. A. Germain

[57] ABSTRACT

An airborne system (10) and method of dispensing a plurality of sub-units (22) such that the ground plane impact pattern of the plurality of sub-units (22) substantially corresponds to a particular geometric target area. An onboard control module (150) including a microprocessor (130) which receives flight data (138) and a selected target data (140) also has a program store of sub-unit ejection sequences (132) and a logic selection of sub-unit ejection velocities (134). The microprocessor (130) selects an appropriate sub-unit ejection sequence and individual sub-unit ejection velocity in accordance with the flight and selected target data and effects a release of the plurality of sub-units in a manner such that they disperse and impact in the pattern of the selected target.

5 Claims, 4 Drawing Sheets

FIG.-1
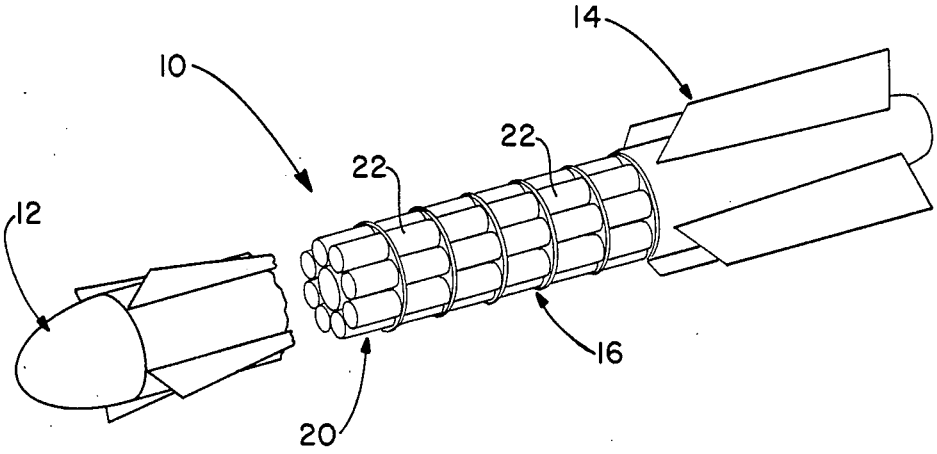
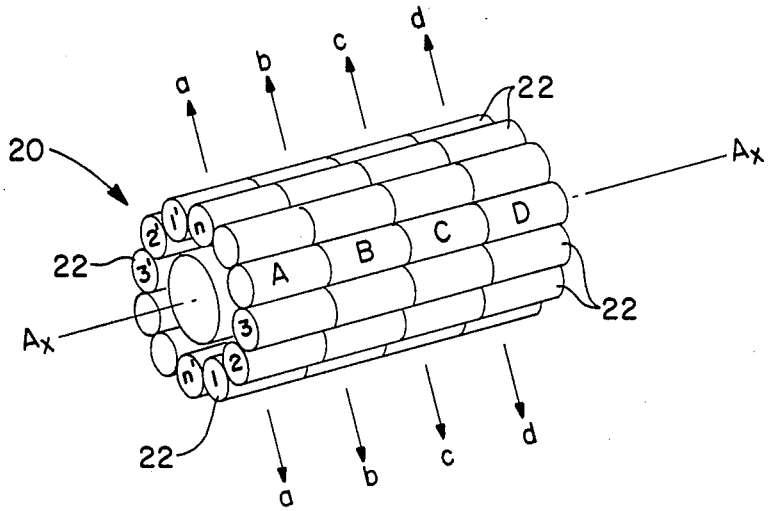
FIG.-2

FIG.-3a
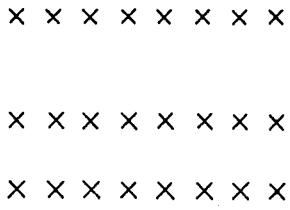
FIG.-3b
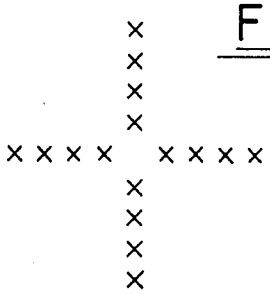
FIG.-3c
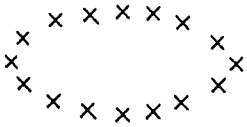
FIG.-3d
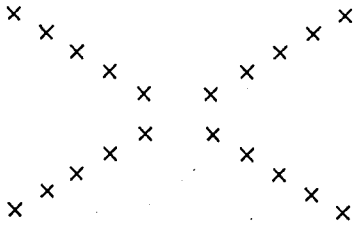
FIG.-3e
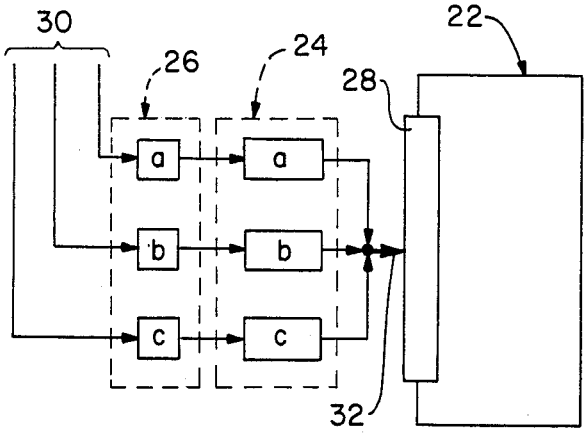
FIG.-5

METHOD AND SYSTEM FOR DISPENSING SUB-UNITS TO ACHIEVE A SELECTED TARGET IMPACT PATTERN

BACKGROUND OF THE INVENTION

This is a continuation-in-part of co-pending prior application Ser. No. 824,826 filed Jan. 31, 1986 entitled "Spin Dispensing Method and Apparatus" and now issued to U.S. Pat. No. 4,676,167 on June 30, 1987.

This invention relates to airborne dispensing and more particularly to a method and system for dispensing a plurality of sub-units in the form of sub-munitions in a manner, to achieve a desired dispersion impact pattern over a specific geometric target area.

In the above-referenced prior application there is disclosed a method and apparatus for dispensing a plurality of sub-units using a spinning dispenser wherein a sub-unit ejection sequence is determined by selected target and spin flight data fed into an onboard microprocessor. The specific target geometry data and spinning flight data results in an ejection signal sequence of individual sub-units which disperse to match the ground plane target geometry and thus provides optimum coverage of the target.

This invention achieves the results of the above-referenced prior invention but utilizes a dispenser system which doesn't require a particular spin rate to obtain sub-unit ejection velocities for the desired dispersion over a ground plane impact area.

Various techniques and apparatus are already known for dispensing a plurality of sub-units in a pattern to cover an impact area. For example, U.S. Pat. No. 2,972,946 discloses an arrangement of bomblets which are simultaneously ejected from a carrier vehicle at a predetermined time after launch from an aircraft. The impact pattern of the dispersed bomblets is predetermined by the manner of their cluster arrangement on the carrier. U.S. Pat. No. 4,372,216 discloses a radial dispersion of sub-units by way of a pressurization system in a manner to have the least destabilizing affect on the carrier vehicle when the sub-units are launched. U.S. Pat. No. 4,455,943 discloses an explosive mechanism for launching submissiles from a supersonic carrier vehicle such that each submissile is oriented within the windstream of the carrier in a manner to maintain a stabilized flight pattern to the target. Finally, Navy Technical Catalog 0501 No. 68837 discloses a gas bag deployment mechanism using a pyrotechnic gas generator for submissile deployment. Incremental ejection velocities of the submissiles result in a dispersion over the target area.

While the above-cited prior known techniques and apparatus for sub-unit dispersion have various advantages, none provide a sequential ejection of individual sub-units at variable velocity and direction to achieve an unlimited variety of impact patterns over a ground plane target area. Further, there is an obvious need in the art for a sub-unit ejection system which has an ability to change the ejection sequence in accordance with any possible target geometry as the carrier vehicle approaches the target.

SUMMARY OF THE INVENTION

It is in accordance with one aspect of the present invention an object to provide a method of dispensing a plurality of sub-units from an airborne carrier in a manner to achieve a desired ground impact pattern over a particular geometric ground plane target area, the method comprising the steps of:

mounting a plurality of sub-units in a balanced arrangment about a longitudinal axis of the carrier;

providing an onboard microprocessor having a program store of particular sub-unit ejection sequences and a selection of sub-unit ejection velocities;

providing impulse ejection means associated with each sub-unit and adapted to provide an ejection velocity in accordance with a signal from the microprocessor;

providing carrier flight data and a selected target data to the microprocessor such that a particular sub-unit ejection sequence is selected from the program store which results in an ejection and dispersion of sub-units substantially corresponding to the particular target geometry; and explosively ejecting the sub-units from the carrier.

It is in accordance with another aspect of the invention an object to provide an airborne system for dispensing a plurality of sub-units in a manner to achieve a desired impact pattern over a particular ground plane target area, the system comprising in combination:

a carrier having a longitudinal axis and defining a forward end, a rearward end, and a payload section between the forward and rearward ends;

a plurality of sub-units mounted individually in the payload section in a balanced arrangement about the longitudinal axis;

an onboard control module including a power supply and a microprocessor, the microprocessor including a program store of particular sub-unit ejection sequences and a selection of sub-unit ejection velocities;

means providing carrier flight data and selected target data to the microprocessor as the carrier approaches the target area; and means associated with each sub-unit for ejecting the sub-unit from the carrier payload section, said means responsive to a signal from the microprocessor to provide a sub-unit ejection velocity in accordance with the microprocessor selection;

said plurality of sub-units being ejected from the carrier in a directional sequence and at variable velocities as determined by the microprocessor selection to disperse and form an impact pattern which substantially matches the target area geometry.

BRIEF DESCRIPTION OF THE DRAWINGS

The invention and various aspects and advantages thereof will be better understood when consideration is given to the following detailed description and the accompanying drawings wherein in the several figures like-reference numerals indicate like-elements and wherein:

FIG. 1 is a perspective view, partially broken away, of a carrier vehicle which may be employed to meet the needs of the invention;

FIG. 2 illustrates a modular configuration of a plurality of sub-units carried by the carrier for deployment in accordance with this invention;

Figure 4:
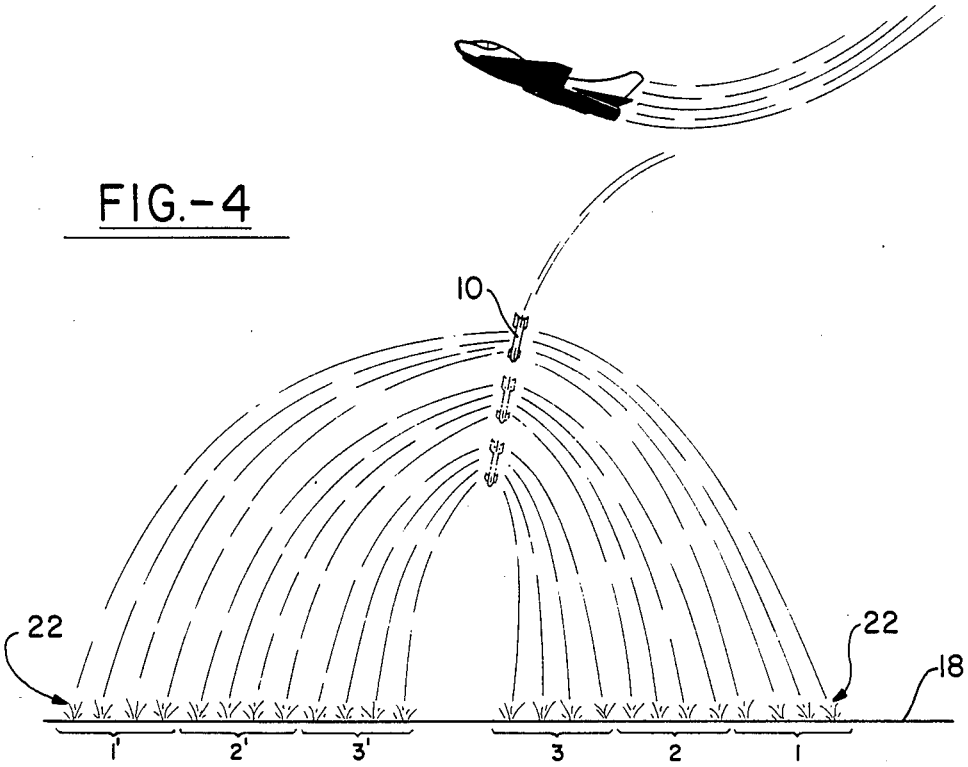

FIGS. *3a–3e*, inclusive, illustrate various impact patterns which may be achieved by this invention, the patterns shown being but a select few of numerous patterns which may be deployed;

FIG. 4 illustrates by way of example a sub-unit ejection sequence which achieves the impact pattern shown in FIG. 3*a;*

Figure 6:
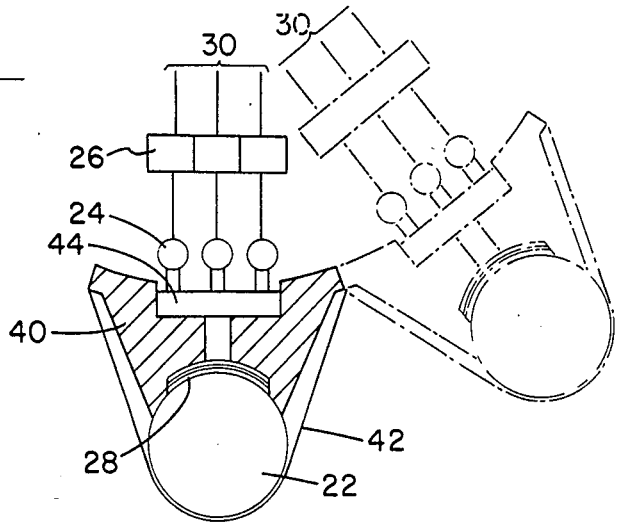
Figure 7:
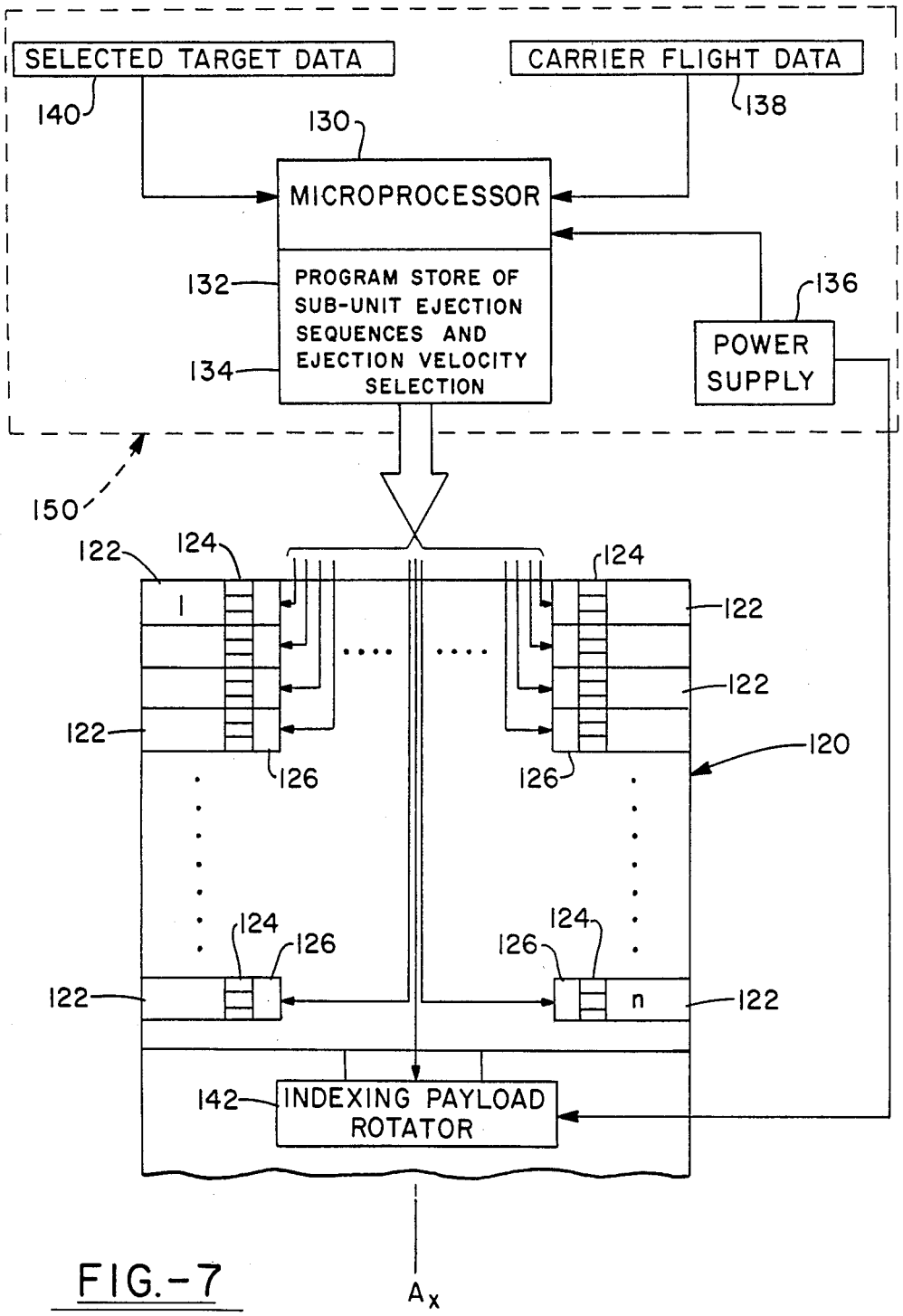

FIG. 5 diagramatically illustrates the manner of achieving a variable ejection velocity of a single sub-unit;

FIG. 6 is a top view showing by way of example a mounting arrangement which may be employed for each sub-unit; and FIG. 7 is a block diagram of the dispenser system configuration.

DETAILED DESCRIPTION OF THE INVENTION

Referring to the drawings, FIG. 1 illustrates a transport carrier of a general type which may be adapated for sub-unit dispensing in accordance with this invention. The carrier is generally indicated by reference numeral 10 and may include a forward nose piece 12, a rearward tail assembly 14, and a central section 16 which is the payload carrying section of the vehicle.

The carrier 10 may be a self-propelled and guided vehicle and in this type configuration the forward nose piece 12 may include appropriate guidance electronics (not shown) while the rearward tail assembly 14 may include appropriate propulsion means (not shown). In an alternative configuration, the carrier 10 may be transported aloft on the underside of an aircraft and used in this manner for launching a plurality of sub-units comprising the payload. Further, the carrier 10 may be transported aloft by an appropriate aircraft and launched in the manner of a bomb and thus directed towards the intended target. In any conceivable configuration which will become apparent to those persons having knowledge and skill in this art, the carrier 10 may be adapted to house and carry the system comprising this invention. Therefore, the scope of the invention is not considered limited by the type and/or configuration of the carrier vehicle 10.

To continue, the carrier 10 includes a payload section 16 and in accordance with this invention the payload comprises a modular arrangement of sub-units generally indicated by reference numeral 20. The payload 20, illustrated in FIG. 2 of the drawings, may be configured with a plurality of sub-units 22 in a modular arrangement about a central longitudinal axis indicated by line Ax—Ax. Because the ultimate ground plane impact pattern of the ejected sub-units 22 is independent of their orientation within the payload 20, the individual sub-units 22 may be arranged in any of various known configurations. The available space within the carrier 10 and the configuration of each sub-unit 22 being considerations, suffice to say that the present invention is not considered limited by the number and/or arrangement of the sub-units 22 and the showing of FIG. 2 is but illustrative of one such arrangement.

To continue, the modular payload arrangement 20 may comprise groups of sub-units indicated in FIG. 2 by letters A, B, C, and D . . . etc., and the sub-units in each group are characterized by ejection velocities indicated by the arrows a, b, c, and d respectively. For example, the group A sub-units are ejected from the carrier payload 20 with a velocity "a" within the range of 1.0–20 ft/sec while the group B sub-units are ejected with a velocity "b" within the range of 20–40 ft/sec. In the same manner, subsequent group C are ejected with a velocity "c" within a range of 40–60 ft/sec and group D are ejected with a velocity "d" within the range 60–80 ft/sec. By way of example, FIGS. 3*a*–3*e* illustrate ground plane impact patterns which may be accomplished and these are but illustrative of the numerous impact patterns which may be achieved by the invention.

In FIG. 4 an aircraft transported carrier 10 is illustrated as it may follow a trajectory towards a target, the target being in the geometric form of FIG. 3*a* and which may be any ground plane surface indicated at 18. The intent is to eject a series of sub-munitions 22 from the carrier 10 in a manner such that they disperse and impact the ground plane in a particular and desired pattern. Accordingly, and referring also to FIG. 2, the vertically oriented sub-munitions in longitudinal rows 1 and 1' are ejected first, the sub-munitions in the various layers A, B, C, and D characterized by differential ejection velocities as hereinbefore described. Each subsequent row, 2,2'. . . etc. will be indexed to the same position and ejected in sequence. The result will be a line of spaced sub-munition impacts along the ground plane as shown in FIG. 4. Thus, it may be shown that by using a combination of variable ejection velocities and radial positions about the payload axis Ax—Ax one may effectively achieve any of the impact patterns of FIGS. 3*a*–3*e* including many others which are not illustrated. In this respect, it should also be obvious that indexed rotation of the payload of sub-units 22 will not be required for other ground impact geometries.

FIG. 5 illustrates a manner of achieving a variable ejection velocity of a single sub-unit 22. An assembly for accomplishing this may comprise a pyrotechnic gas generator 24, ignitor means 26, an explosively inflatable gas bag 28, and a source of actuating signals 30 which provide the requisite ignition energy to the ignitor means 26. Apparatus of the above general description are within the state of the art as evidenced by Navy Technical Catalog 0501 hereinbefore described. However, in accordance with this invention each sub-unit 22 must be subject to a variable ejection velocity and this may be provided by a variable output gas generator 24 or alternatively by a plurality of individual gas generators identified by letter "a", "b" . . . etc. in the drawing. These all will feed a common output 32 which may be a common manifold assembly to explosively inflate the gas bag 28. In this configuration, separate ignitor means 26*a*, 26*b* . . . etc. may be provided to each gas generator 24 and these are fired by signals from a selection logic forming a part of a program store within a microprocessor memory. Thus, the selection logic signals 30 may pick any combination of gas generators 24*a*, 24*b* . . . etc. such that the output force on each specific sub-unit 22 is applied in accordance with the logic selection.

FIG. 6 illustrates a particular hardware configuration for a single sub-unit 22, adjacent ones of the payload 20 being shown in ghost lines. A sub-unit 22 is mounted to a suitable fixture 40 by a restraining strap or like means 42. The strap 42 may be of various types to provide a separation of the sub-unit 22 at the appropriate instant of time. For example, strap 42 may be separated by an electrically and/or explosively operated cutter (not shown) or by a separation at the minimum ejection force exerted on the sub-unit 22 by the explosively inflated gas bag 28. The gas bag 28 may be of any known construction suitable for this application and it is mounted in association with the sub-unit 22 and a manifold assembly indicated at 44. The manifold assembly 44 is needed when multiple gas generators 24 are used as shown in FIG. 5. While the drawing illustrates an ejection assembly for a single sub-unit 22, it should be understood that there will be one such ejection mechanism for each sub-unit within the payload module 20.

FIG. 7 is a block diagram illustrating the general layout of the dispenser system comprising this invention. A payload section is generally indicated by reference numeral 120 and it includes a plurality of ejectable sub-units 122, the number of such sub-units being indicated by numerals "1"... "n". Each sub-unit 122 has an associated variable output ejection means 124 activated by an ignitor means 126. The ignitor means 126 receives ignition selection signals from a control module generally indicated by numeral 150. The control module 150 includes a microprocessor 130 which has a program store of sub-unit ejection sequences 132 and an ejection velocity selection logic 134. Power for the microprocessor 130 is provided by a power supply 136. The microprocessor 130 receives input data from apparatus providing carrier flight data 138 and these may comprise conventional real-time sensors (not shown) which would be mounted in the nose piece 12 of the carrier vehicle 10. The microprocessor 130 also receives selected target data 140 and this may be provided by various means including any of the following: (a) a pre-programmed store is provided prior to launch when the specific target geometry is known, (b) a data link after launch from an aircraft, (c) an onboard target sensor which determines the target geometry as the carrier approaches the target. In any event, the microprocessor 130 is programmable such as to select from the store of firing sequences 132 a particular combination of firing sequences and sub-unit ejection velocities 134 which will result in the plurality of ejected sub-units impacting the target area in a pattern which substantially matches the ground plane target geometry. Also included in the diagram of FIG. 7 is a mechanism 142 which rotates the payload 120 about its axis Ax in an indexed manner such that the sub-units 122 may be ejected directionally to form a line impact pattern as illustrated in the example of FIG. 3*a* and FIG. 4. The indexed rotator 142 may be of any known configuration and will be mounted within the confines of the carrier 10, either at the forward or rearward ends and under the control of the microprocessor 130. Power for the mechanism 142 may be supplied by the power supply 136.

While a single embodiment of the invention has been illustrated and described in detail, it is to be understood that the invention is not limited thereto or thereby, but that various modifications may become apparent to those persons skilled in the art and these are considered to fall within the scope of the appended claims.

What is claimed is:

1. A method of dispensing a plurality of sub-units from an airborne carrier in a manner to achieve a desired impact pattern over a particular geometric ground plane target area comprising the steps of:

mounting a plurality of sub-units in a balanced arrangement about a longitudinal axis of the carrier;

providing an onboard microprocessor having a program store of particular sub-unit ejection sequences and a logic selection of sub-unit ejection velocities;

providing ejection means for each sub-unit adapted to provide a particular ejection velocity in accordance with a selected signal from the microprocessor;

providing carrier flight data and a selected target data to the microprocessor such that a particular sub-unit ejection sequence is selected from the program store which results in an ejection and dispersion of sub-units substantially corresponding to the particular target geometry; and explosively ejecting the plurality of sub-units from the carrier in accordance with the microprocessor selected ejection sequence.

2. The method as set forth in claim 1 wherein the selected target data is provided by preprogramming the microprocessor with such selected target data.

3. The method as set forth in claim 1 wherein providing selected target data is accomplished by collecting real-time target data as the carrier approaches the target area.

4. The method as set forth in claim 1 wherein providing selected target data is accomplished by obtaining such data from a soure remote to the carrier via a data link.

5. The method as set forth in claim 1 further comprising the step of rotating the payload of sub-units to an indexed position and ejecting opposite pairs of sub-units about the longitudinal axis from the indexed position.

* * * * *